United States Patent [19]

Haas

[11] 4,328,819

[45] May 11, 1982

[54] VIBRATING NAIL TRIMMER

[76] Inventor: Everett L. Haas, #73 Wellington Dr., Middlebrook, Bristol, Tenn. 37620

[21] Appl. No.: 212,590

[22] Filed: Dec. 3, 1980

[51] Int. Cl.[3] ..... A45D 29/05

[52] U.S. Cl. ..... 132/73.6

[58] Field of Search ..... 132/73.6, 75.4, 75.5, 132/75.8

[56] References Cited

U.S. PATENT DOCUMENTS 1,562,110 11/1925 Mash ..... 132/73.6

2,544,248 3/1951 Ashmead ..... 132/73.6

*Primary Examiner*—G. E. McNeill

*Attorney, Agent, or Firm*—Mitchell B. Wasson; Martin P. Hoffman

[57] ABSTRACT

A hand-held vibrating nail trimmer which facilitates the management of finger or toe nails. The trimmer contains a small electric motor which vibrates a serrated blade placed on top of the nail. The vibratory action of the blade penetrates the relatively brittle surface of the nail, thereby trimming the nail. Because of the flexible nature of the underlying skin and tissue, it will move in unison with the blade and therefore resist being damaged.

7 Claims, 4 Drawing Figures

FIG. 1.
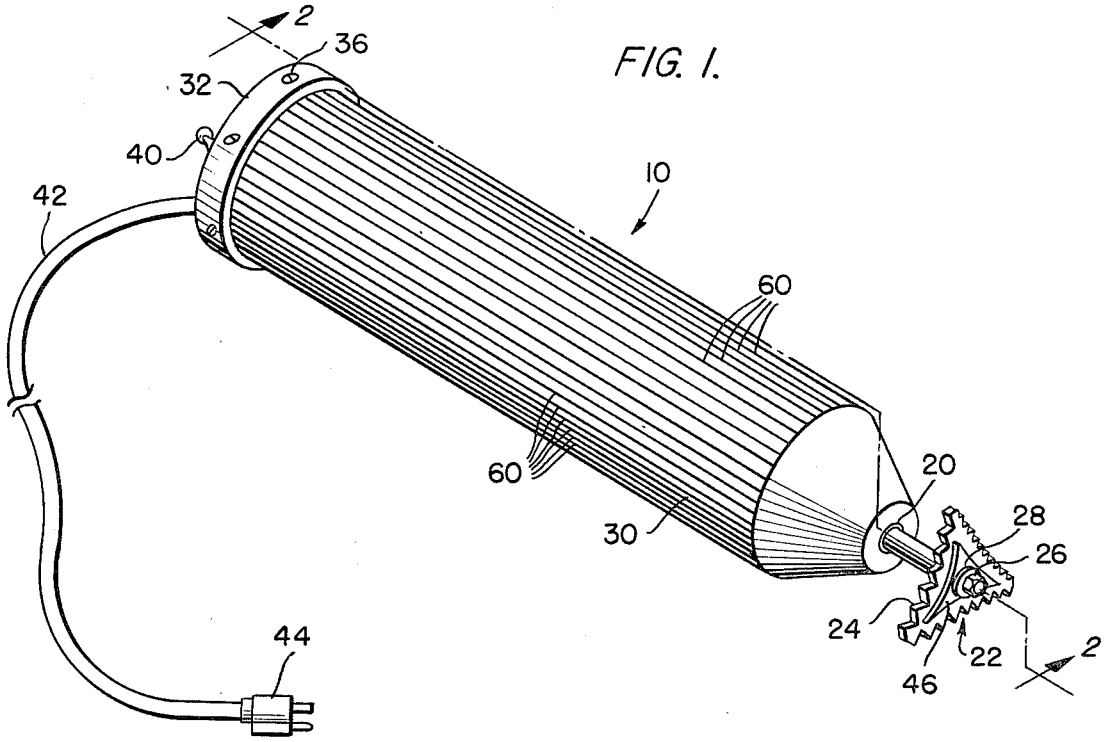
FIG. 2.
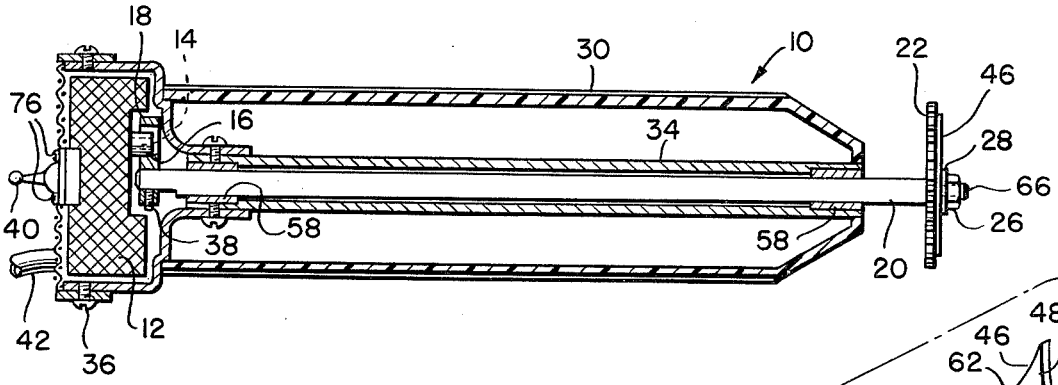
FIG. 3.
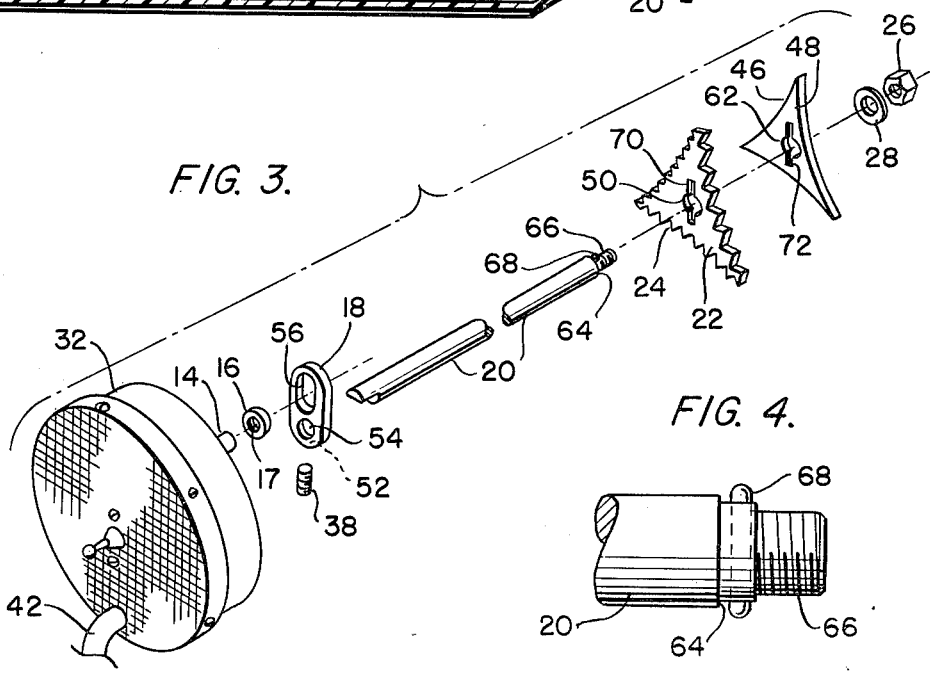
FIG. 4.

VIBRATING NAIL TRIMMER

BACKGROUND OF THE INVENTION

The majority of prior art nail trimmers are mechanically constructed and include two opposed blades. The nail is inserted between the blades and a lever handle is depressed, forcing the blades together and thereby slicing through the nail. However, while these mechanical clippers are seemingly easy to operate, problems can arise which would make the utilization of these clippers difficult.

Various medical conditions, such as fungus growth or merely the normal aging process can cause thickening of the toenails. This is especially true for the nail on the great toe or hallux. This thickening makes it very difficult or impossible to insert the nail between the opposed blades of the mechanical clipper. Additionally, even if the nail can be properly inserted, other conditions, such as arthritis or neuritis which might be present in conjunction with the thickened or ingrown nail, would prevent the user from applying sufficient pressure to the lever handle to sever the nail, or cause pain and tissue damage to the user. Therefore, an electrically powered vibratory nail trimmer which would be simple to use by elderly people would be quite advantageous.

A number of U.S. patents such as U.S. Pat. Nos. 2,544,248 issued to Ashmead; 2,597,526 issued to Kessler; 3,081,782 issued to Funk; 3,596,667 issued to Buercklin; 4,016,890 issued to Fiorenza, Sr. et al.; and 4,177,854 issued to Rosenbloom relate to electrically powered manicuring devices. However, these patents are primarily used to buff fingernails, not to cut or trim the nails.

U.S. Pat. No. 2,131,628, issued to Kohl, describes a hand-held electric vibrating mechanism used for nail care. However, as was true with the above-cited patents, this patent is directed to manicuring, but not the cutting of the nail.

U.S. Pat. No. 3,554,197, issued to Dobbie, describes a portable powered saw which utilizes a blade oscillating about the center of a circle. An electric motor produces rotary motion which is converted into oscillatory motion at the blade. This patent includes an oscillating pivot arm unit using an extended convex blade protruding horizontally from the end of the tool, whereby oscillation is performed by a motor driven spring attached to the blade mounting. This patent is used to cut bones during surgery and would be difficult to be adapted to use as a nail trimmer.

Other U.S. patents of interest include U.S. Pat. Nos. 2,336,017 issued to Fortune; 2,427,580 issued to Stryker; and 3,533,161 issued to Magnin. These patents describe devices used for cutting plaster casts which cannot easily be used to trim nails.

SUMMARY OF THE INVENTION

The problems of the prior art are overcome inasmuch as the present invention is directed to a hand-held nail trimmer utilizing a vibrating blade powered by a small AC motor. A direct drive shaft in conjunction with a connection yoke and an off-center cam bearing provides vibratory motion to a blade containing a serrated edge. The vibrating blade is placed on top of a nail, preferably a toe nail, and is activated to begin the trimming process. The vibratory action of the blade penetrates the relatively brittle surface of the nail, thereby trimming the nail. Because of the flexible nature of the underlying skin and tissue, it will move in unison with the blade and therefore resist being damaged.

BRIEF DESCRIPTION OF THE DRAWINGS

A more complete appreciation of the present invention will be readily obtained as the same becomes understood by reference to the following detailed description when considered in connection with the accompanying drawings, wherein:

FIG. 1 is a perspective view of the nail trimmer constructed in accordance with the present invention;

FIG. 2 is a cross-sectional side elevation of the trimmer shown in FIG. 1;

FIG. 3 is an exploded view showing the operational connections along the elongated drive shaft; and FIG. 4 is a side elevation of the distal end of the elongated drive shaft.

DESCRIPTION OF A PREFERRED EMBODIMENT

Referring to the drawings, FIGS. 1 and 2 illustrate a nail trimmer 10 which is predominately cylindrical in shape similar to a thick pencil or electric toothbrush so that control and manipulation of the instrument can be easily managed. A case cover 30, as well as motor cover 32, encases substantially the entire length of the nail trimmer 10. A sleeve tubing 34 extends within the case cover 30 for substantially the entire length of the cover. Although the exact material constituting the tubing 34, and covers 30 and 32, can vary, it has been found that a plastic or aluminum material provide satisfactory results. Flutes 60 are provided in the covers 30 and 32 for ensuring that the trimmer can be easily gripped and manipulated. Set screws 36 are provided to protectively enclose the case cover 30 and motor cover 32 around the inner mechanisms of the nail trimmer 10.

A 115 volt AC variable speed electrical motor 12 is provided in the proximal end of the trimmer 10 to provide power. The speed of the motor is variable to eliminate friction. The motor contains a rotating drive shaft 14. The shaft 14 is connected to an off-center cam bearing 16 which is used to convert the rotating movement of the motor drive shaft to vibratory motion used to trim the nails. The cam bearing 16 is connected to a yoke 18 positively connected by an elongated, cylindrical drive shaft 20 which is provided within the entire length of sleeve tubing 34. Two bearings 58 encircle the drive shaft 20 at both ends thereof to provide efficient operation. A vibrating blade 22 having at least one serrated edge 24 is affixed to the distal end of the drive shaft 20 by means of a nut 26 and washer 28.

The distal end of the drive shaft 20 is threaded 66 to allow mating with the nut 26, and to ensure that the blade 22 will not become dislodged during operation of the trimmer. An axial pin 68 extends through the drive shaft 20 slightly in back of threads 66 and a stop member 64. This pin registers with slots 70 of a registry hole 50. The diameter of the hole 50 is greater than the diameter of the threaded portion of the drive shaft end 66. The blade 22 is placed onto the pin 68 or between the stop 64 and the pin 68 by aligning the slots 70 with pin 68. In this manner, the blade 22 will not become dislodged during the operation of the trimmer and any one of the various blade surfaces can be utilized. A safety shield 46 having slots 72 and a registry hole 62 similarly dimensioned as the slots 70 and the registry hole 50 of the blade can be provided either between the blade 22 and stop 64 or between the blade 22 and pin 68. As was true with the blade 22, the shield 46 is placed on the drive shaft 20 by aligning the slots 72 of the registry hole 62 with the pins 68. The function of this shield 46 will be explained below.

A standard rotor or round switch 40 is provided on the exterior of the motor cover 32 to alter the speed of the variable speed motor and thereby the speed of the vibration of the blade as well as to activate or cease the operation of the motor 12. The switch is positively affixed to cover 32 by a plurality of set screws 76. The motor is connected to an external source of power via a standard three wire cable 42 provided with a standard three prong plug 44. Although it is not shown, it should be noted that an external source of power is not necessary and the motor 12 could be powered by a suitable battery source.

The transference of the rotary motion of the motor 12 to a vibratory motion of the drive shaft 20 will now be explained with the assistance of FIG. 3. The motor 12 contains a cylindrical drive shaft 14 which rotates when the motor is activated. A one-quarter inch outer diameter cam bearing 16 with a one-sixteenth inch off center throw is provided and retained by the motor drive shaft 14 by a screw (not shown). The cam bearing is provided in a one-quarter inch inner diameter longitudinal slot 56 provided in yoke 18. The yoke 18 is permanently joined to the drive shaft 20 by a press fit through hole 54 in the yoke 18. Additionally, a set screw 38 provided in slot 52 of yoke 18 positively joins the drive shaft 14 to the yoke 18. Therefore, when the motor 12 is activated, the rotation of motor drive shaft 14 is transferred to the cam bearing 16. Since this cam bearing is off-center and works in the longitudinal slot 56, the rotation of this bearing is transferred to a vibratory motion in yoke 18, drive shaft 20 and ultimately blade 20 of approximtely 0.062 inch directional in distance. It should be noted that the dimensions given hereinabove are merely illustrative. The present invention is not meant to be so limited.

As shown in FIGS. 1 and 3, the blade 22 consists of three concave shaped serrated edges 24. Each of the three edges contain a different number of serrations or teeth per inch depending upon the type of nail or the condition of the nail to be trimmed. For example, the number of teeth on the outer edge of the blade can vary between 15 to 32 teeth per inch, although a lesser or greater amount of teeth could also be utilized. Furthermore, a plurality of different blades could also be used.

The shield 46 having three concave edges 48 bereft of teeth or serrations can be used for safety purposes. As indicated hereinabove, the present invention operates utilizing a vibratory action. Since the nail is relatively rigid and brittle, the vibratory action of the blade will sever a portion of the nail which is to be trimmed. When this portion of the nail has been severed, the under skin or tissue will not be damaged since its flexibility allows it to vibrate in unison with the blade. However, to insure that the teeth 24 of the blade 22 will only be inserted to a maximum depth, the shield 46 is provided. The concave edges 48 of the shield mirror the outline of the edges 24 of the blade 22. When brought in a side-by-side relation, the edge 48 of the shield 46 should extend next to the top (side nearest to registry hole 50) of the teeth 24 of the blade 22. In this manner, the teeth 24 could only extend a predetermined amount into the tissue beneath the user's nails. Additionally, each side of the shield can extend to a different relationship with respect to teeth 24 of blade 22, thereby altering the maximum depth of the blade 22 into the underlying tissue.

The operation of the nail trimmer is as follows: Depending upon the particular type of nail which is to be trimmed and the condition of the underlying tissue, a proper blade and shield are selected and are placed securely on the drive shaft and the nut 26 and washer 28 are properly affixed. The three pronged plug is placed in a standard wall socket and the switch 40 is activated thus creating a vibratory action of the blade 22. The vibratory blade is then placed on top of the nail and a slight downward pressure is applied to the handle of the trimmer and therefore to the blade. The vibratory action of the blade severs the nail, but not the underlying skin due to the flexible nature of the tissue as well as the safety shield.

While the described embodiment represents the preferred form of the present invention, it is to be understood that modifications will occur to those skilled in the art without departing from the spirit of the invention. It is therefore to be understood that within the scope of the appended claims, the invention may be practiced otherwise than as specifically described herein.

What is claimed is:

1. An electrically powered nail trimmer comprising:
- a source of electrical power;
- a motor connected to said source of electrical power, said motor means having a rotatable drive shaft;
- transfer means connected to said rotatable drive shaft for producing vibratory motion;
- an elongated drive shaft connected to said transfer means; and
- a blade connected to said elongated drive shaft, said blade having a surface capable of severing a nail as it moves back and forth across the top of the nail surface, whereby said blade vibrates across a surface to be trimmed, thereby severing a portion of the surface.

2. An electrically powered nail trimmer in accordance with claim 1, further including a safety shield provided adjacent to said blade.

3. An electrically powered nail trimmer in accordance with claims 1 or 2 wherein said transfer means includes an off-center cam bearing connected to said rotatable drive shaft, a yoke operationally connected to said off-center cam bearing and positively connected to said elongated drive shaft.

4. An electrically powered nail trimmer in accordance with claim 3 further including a handle means enclosing said motor, said transfer means and substantially enclosing said elongated drive shaft.

5. An electrically powered nail trimmer in accordance with claim 1 wherein said blade is provided with at least one concave trimming surface.

6. An electrically powered nail trimmer in accordance with claim 5 wherein said blade is provided with a plurality of concave trimming surfaces.

7. A method of trimming nails comprising the steps of:
- presenting a vibratory trimming surface to the nail, said surface vibrating across the surface of the nail, said vibratory trimming surface capable of severing the nail as it moves back and forth across the top of the nail surface, and
- exerting a slight downward pressure on said vibratory trimming surface,
- whereby the vibratory action of said trimming surface severs the nail, but does not damage the underlying skin.

* * * * *